US005454482A

United States Patent [19]

Simon

[11] Patent Number: 5,454,482

[45] Date of Patent: Oct. 3, 1995

[54] SAFETY DRINKING CONTAINER

[75] Inventor: Jeffrey L. Simon, Clifton Park, N.Y.

[73] Assignee: Health Research, Inc., Albany, N.Y.

[21] Appl. No.: 138,752

[22] Filed: Oct. 18, 1993

Related U.S. Application Data

[63] Continuation-in-part of Ser. No. 65,929, May 21, 1993, abandoned.

[51] Int. Cl.[6] ..... A47G 19/22

[52] U.S. Cl. ..... 220/713; 220/718; 220/771; 220/339; 220/373; 220/375

[58] Field of Search ..... 220/704, 710.5, 220/711, 713, 716, 717, 718, 771, 337, 338, 339, 373, 375

[56] References Cited

U.S. PATENT DOCUMENTS

| | | | |
|---|---|---|---|
| 2,534,614 | 12/1950 | Michael | 220/713 |
| 2,623,368 | 12/1952 | Olsen | 220/711 |
| 4,643,326 | 2/1987 | Klingler | 220/375 X |
| 4,655,363 | 4/1987 | Neat | 220/375 X |

FOREIGN PATENT DOCUMENTS

| | | | |
|---|---|---|---|
| 89098 | 3/1948 | Netherlands | 220/713 |
| 1229426 | 12/1988 | United Kingdom | 220/713 |
| 2205309 | 12/1988 | United Kingdom | 220/713 |
| 2206106 | 12/1988 | United Kingdom | 220/713 |

*Primary Examiner*—Allan N. Shoap
*Assistant Examiner*—Stephen Cronin
*Attorney, Agent, or Firm*—Hoffmann & Baron

[57] ABSTRACT

A safety drinking container for controlled release of liquid contained therein, particularly hot beverages and the like. The safety container includes base and lid portions which engage one another in sealing relationship during use. In one preferred embodiment, the lid portion includes at least one drinking passage arranged to be covered by the mouth of an individual during consumption of a liquid, while the base portion is configured with an edge surrounding an opening in the base portion which discourages the individual from consuming the liquid directly from the base portion. In another preferred embodiment, the base portion includes a top having an opening formed therein. The opening is defined by an edge which discourages the individual from consuming the liquid directly from the base portion. The base portion including at least one drinking passage arranged to be covered by the mouth of the individual.

19 Claims, 8 Drawing Sheets

SAFETY DRINKING CONTAINER

This application is a Continuation-In-Part of U.S. patent application Ser. No. 08/065,929 filed May 21, 1993 abandoned.

BACKGROUND OF THE INVENTION

The present invention relates to drinking containers and, in particular, to drinking containers designed for controlled release of liquid, such as hot beverages.

There are a variety of situations in which an individual consuming a hot beverage is concerned with spillage of the beverage from the container. One commonly encountered situation which is potentially quite dangerous concerns parents of small children who consume hot beverages while such children are in their presence. This potentially dangerous situation arises because children have a tendency to reach out and grasp objects located in their proximity. Specifically, a parent who pours himself or herself a hot beverage, for example, into a typical coffee mug, and then leaves such mug on a counter or table within reach of his or her child, has created a situation quite dangerous to the child. More specifically, if the child grasps for the mug containing the hot beverage, it is most likely that the entire contents of the mug will be spilled on the child, thereby scalding the child, before the parent has time to react.

Additionally, the elderly, who may have difficultly in consuming beverages because of coordination, depth perception or other debilitating conditions, are prone to scalding themselves while drinking a hot beverage from a conventional cup or mug. Further, those individuals who consume hot beverages while operating or riding in a motor vehicle are also prone to scalding themselves due to spillage of the beverage from the container. In this situation, the scalding of the individual could potentially lead to an automobile accident if such individual is operating the automobile.

The prior art has attempted to address these problems by providing drinking vessels with structural features designed to prevent spillage of liquid. For example, the "Sippy Cup" for toddlers is provided with a lid having holes which permit sipping from the cups. The configuration of the cup, however, is such that liquid is easily consumed by removal of the lid. Moreover, the holes of the "Sippy Cup" are of a size and shape which permit relatively unrestrained passage of liquid therethrough. Thus, the "Sippy Cup" permits relatively free spillage when turned on its side or upside down, and does not discourage the user from drinking with the lid removed. Furthermore, the "Sippy Cup" is not designed to be used with hot liquids.

Another feature found in drinking cups of the prior art is an expanded-bottom which supposedly prevents spillage of liquid while traveling in a vehicle. However, these "Travel Mugs," as they are commonly called, do not possess any feature which prevents liquid from spilling out of the mug when tipped over or held upside down, nor do they have a design which prevents sloshing liquid from splashing out of the mug.

In recent years, disposable cups have also been provided with removable plastic lids which have a perforated cut-out that can be removed by the user to form a single drinking spout. The drinking spout, however, is quite large and permits unrestricted flow of fluid from the cup when tipped over. Moreover, these removable plastic lids readily separate from the lip of the cup, particularly when a force is exerted against the wall of the cup. Finally, disposable drinking cups are easily tipped over.

It is, therefore, an object of the present invention to provide a safety drinking container which overcomes the drawbacks associated with drinking cups of the prior art.

SUMMARY OF THE INVENTION

The present invention, which addresses the needs of the prior art, provides a safety container for drinking liquids. The container includes a base portion having a bottom, a continuous side wall connected to the bottom, and an opening formed by an edge of the continuous side wall opposite the bottom. The edge is configured to induce uncontrolled fluid flow to discourage a consumer from drinking the liquid directly from the base portion. The container also includes a lid portion shaped and dimensioned to be removably secured to the edge of the base portion during liquid consumption. Finally, the container includes at least one drinking passage formed in the lid portion. The passage is arranged to be covered by the mouth of the consumer during consumption of the liquid. Further, the passage has a size which permits controlled flow of liquid from the container.

In a preferred embodiment, the lid includes two sets of co-located multiple openings which are spaced sufficiently close together so that all of the openings are entirely covered by the mouth of the consumer during consumption of the liquid. One preferred embodiment includes a lid having seven passages, each having a diameter of approximately 1/16'.

In another preferred embodiment, the safety drinking container includes a base portion having a bottom, a continuous side wall connected to the bottom and a top connected to the side wall. The top includes an opening located substantially opposite the bottom. The opening is defined by an edge formed in the top. This edge is configured to induce uncontrolled fluid flow to discourage an individual from consuming the liquid directly from the opening in the base portion. The container also includes a lid portion shaped and dimensioned for being removably secured to the edge during liquid consumption. Finally, the container includes at least one drinking passage formed in the base portion and arranged to be covered by the mouth of a consumer during consumption of the liquid. This passage has a size which permits controlled flow of liquid from the container.

As a result of the present invention, a container is provided which permits safe drinking of liquids while essentially eliminating the possibility of noticeable spillage. The safety drinking container of the present invention is especially useful in preventing scalding of individuals while drinking hot liquids such as coffee, tea, broth, hot chocolate, etc.

Thus, the container of the present invention permits safe use by adults who prepare and consume hot beverages in close proximity to infants, toddlers, or young children. The safety container of the present invention also prevents scalding of the elderly who may have difficulty in consuming food because of coordination, depth perception or other debilitating conditions. Additionally, the present invention is beneficial to those who drink hot beverages while operating or riding in a motor vehicle.

DETAILED DESCRIPTION OF THE INVENTION

Figure 1:
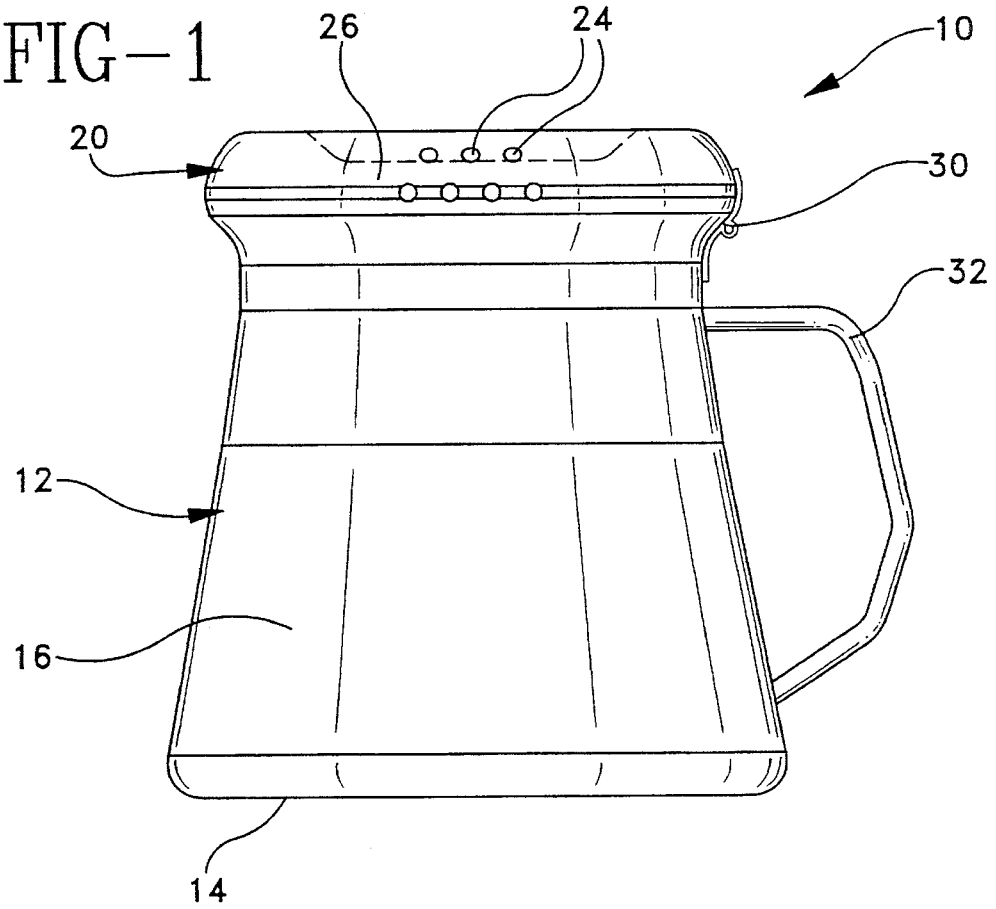
FIG. 1 is a side elevational view of the safety container of the present invention.
Figure 2:
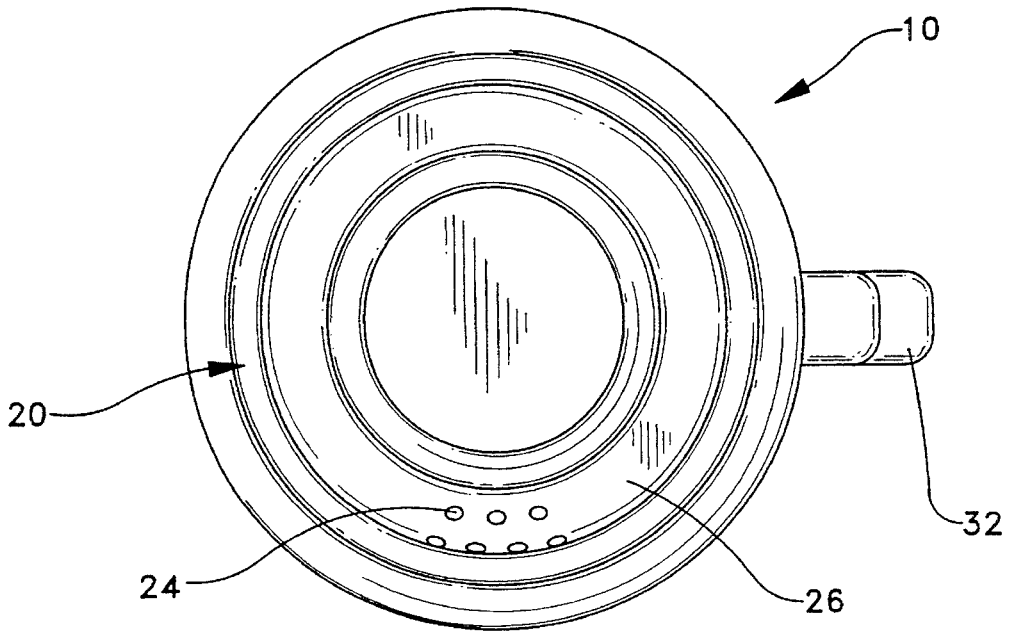
FIG. 2 is a top plan view of the container shown in FIG. 1.
Figure 3:
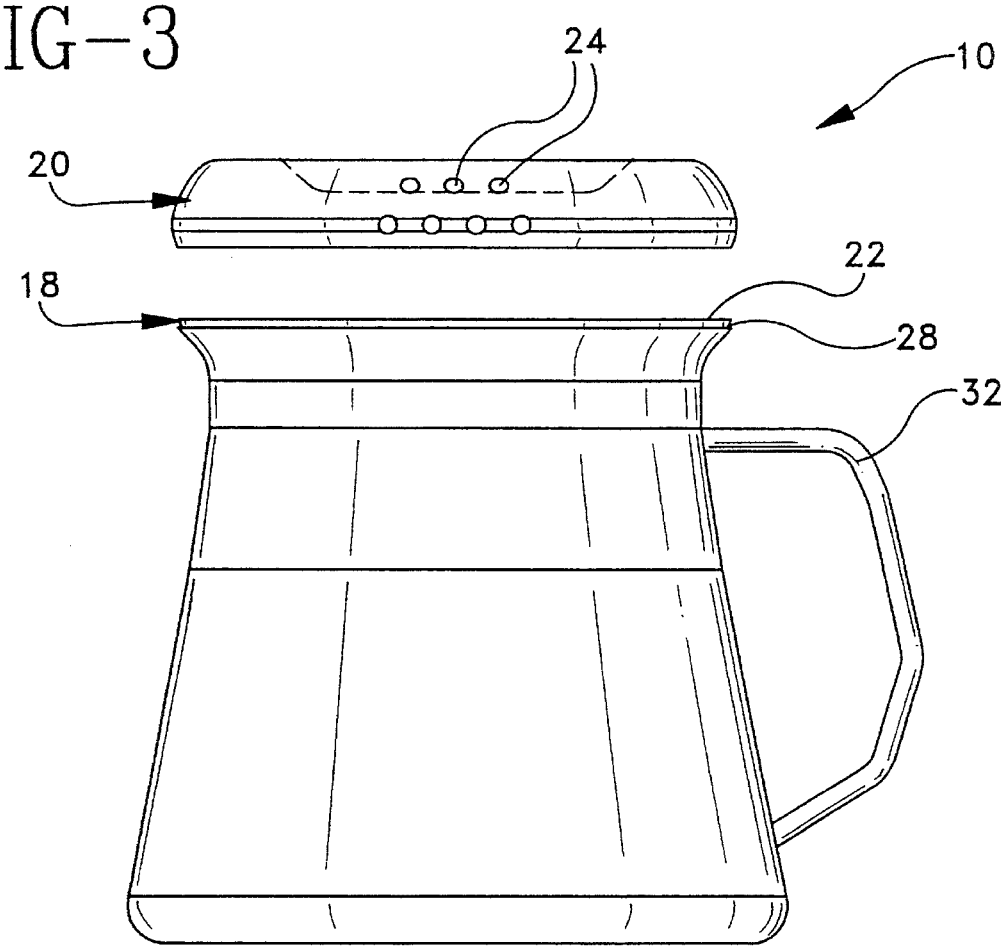
FIG. 3 is an exploded view of the assembled container shown in FIG. 1.

Referring to the drawings, a safety drinking cup 10 formed in accordance with the present invention is shown in FIGS. 1–3. Cup 10 includes a base portion 12 having a bottom 14, a continuous side wall 16 and an edge 18 (best shown in FIG. 3). Container 10 also includes a lid portion 20 shaped and dimensioned to be removably secured to edge 18, thereby enclosing opening 22 in base portion 12.

Lid portion 20 includes at least one passage 24. Passage(s) 24 connects the interior of base portion 12 (in which the liquid is stored) and the exterior of the container when the lid portion is engaged with edge 18. Lid portion 20 further includes a lip portion 26 which protrudes upwardly to facilitate access by the individuals mouth. Lip portion 26 preferably includes passage(s) 24.

Preferably, the lip portion includes a plurality of passages. These passages are located close to one another and are sized so that they are entirely covered by the mouth of the individual during drinking. In this fashion, a partial negative pressure is created in the container so that flow therefrom is restricted. Thus, the individual is required to suck the beverage from the container. When the container is tipped, or when a beverage is sloshed above while in the container, the design of the container prevents spillage or free flow of the liquid.

In an alternative embodiment, at least two passages can be provided wherein one is located at a distance from the other so that during drinking, the container is vented to the atmosphere so that atmospheric pressure is equalized inside and outside of the container thereby enhancing flow of fluid therefrom into the mouth of the user. This alternative embodiment may include passages located on either side of the container so that the container can be easily used with the left or right hand and pressure is equilibrated during use.

Figure 5A:
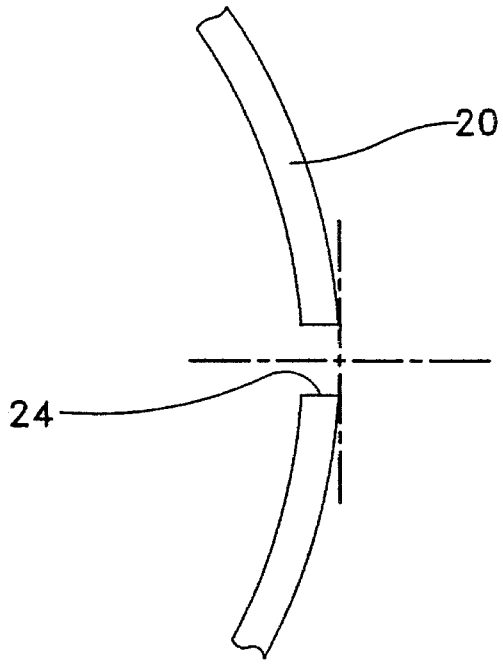
FIG. 5*a* depicts the axis of the passage being perpendicular to a plane which passes along the tangent of the surface of the lid at that point.
Figure 5B:
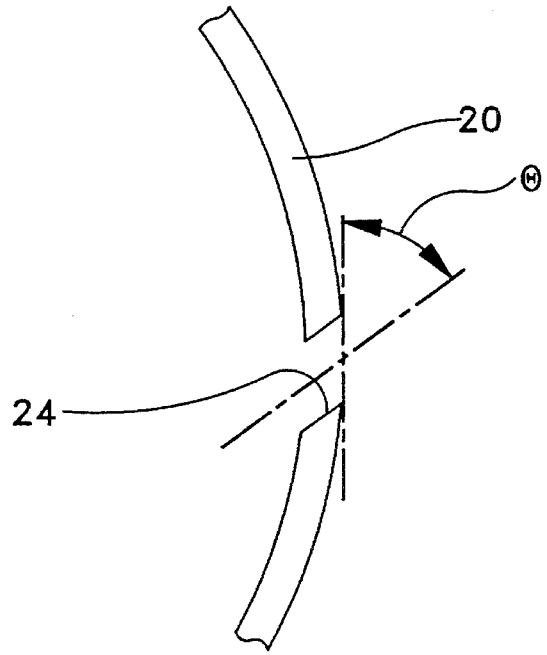
FIG. 5*b* depicts a passage having an axis disposed at an angle Θ to the plane passing along the tangent of the surface of the lid at that point.

Preferably, the passages are circular in construction and have a diameter no greater than 1/16 inch and, more preferably, between 1/32 and 1/16 inches. Further, in a preferred embodiment the axis passing through the passage is substantially perpendicular (or orthogonal) to a plane which passes along the tangent of the surface of the lid at that point. (See FIG. 5*a*) However, in another preferred embodiment, the passages are located at an angle Θ with respect to the plane passing along the tangent of the surface of the lid at that point (see FIG. 5*b*). This angle can be easily implemented into the container by those skilled in the art depending on the intended effect which the artisan wishes to create during drinking.

Referring to FIG. 3, one of the important features of the present invention is the configuration of edge 18, which surrounds opening 22. Particularly, edge 18 is configured to hinder the consumption of the beverage contained in the base portion when the lid is not employed. For example, as shown in FIG. 3, edge 18 has an outwardly diverging flange 28 having a reverse angle slope which increases the possibility of spilling the liquid during consumption of the beverage directly from the base portion. When faced with this possibility, the individual is discouraged from using the container without the lid portion being fastened to the base portion. Otherwise, it would be quite easy for the individual to merely hold the lid portion in the open position, or, even remove the lid portion altogether in order to consume liquids. The present invention is not limited, however, to only an outwardly diverging flange, but any other configuration which would make it difficult for the user to consume liquid directly from the base portion.

Stated differently, edge 18 is configured to induce uncontrolled fluid flow from the base portion if an individual attempts to drink directly from such base portion. Conversely, controlled drinking flow is a flow which provides a coherent and suitably sized stream of liquid to facilitate being directed into a human's mouth. This is contrasted with a wide, uncontrolled, and generally non-coherent flow which causes unrestricted splashing of fluid onto the user. Edge 18 is configured to cause this uncontrolled flow so that the individual is discouraged from using the drinking vessel with the lid removed.

In a preferred embodiment of the present invention, lid portion 20 is configured to snap fit in sealing relationship over edge 18. A hinge 30 connected on one end to base portion 12 and on the other to lid portion 20 allows the lid portion to be unsnapped from the base portion, and yet be retained to the base portion for easy securement thereto following filling of the container (see FIG. 1). Further, the container includes a handle 32 for holding and manipulating the container during drinking of the beverage contained therein.

Figure 4:
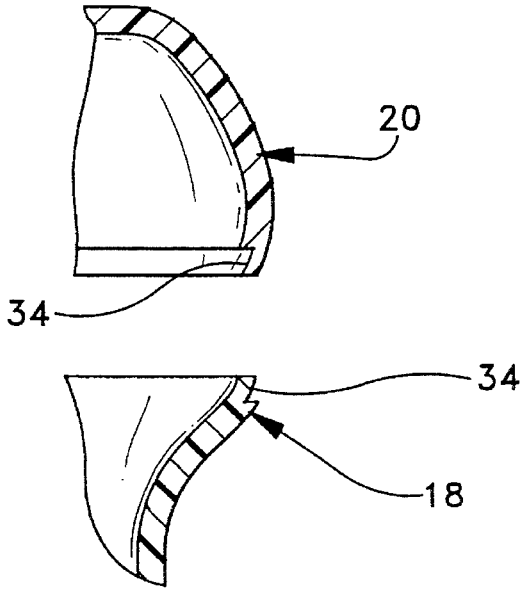
FIG. 4 is an exploded partial section view taken through the lid and base portions of the container shown in FIG. 1.

The snap fit arrangement of the lid and base portions is shown in detail in FIG. 4. Particularly, both edge 18 and lid portion 20 are formed with a pair of opposing shoulders 34 configured to sealingly engage one another and to remain engaged due to friction.

Figure 4A:
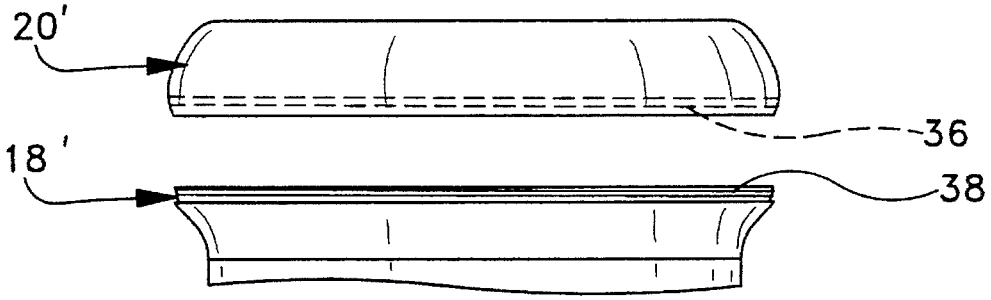
FIG. 4*a* is an exploded view of an alternative embodiment of the present invention wherein the lid and edges of the container include mating threaded surfaces for sealing engagement.

Alternatively, the lid portion and edge of the base may be provided with mating threaded portions. As shown in FIG. 4*a*, lid portion 20' is provided with internal threads 36 which mate with external threads 38 located on edge 18'.

Figure 4B:
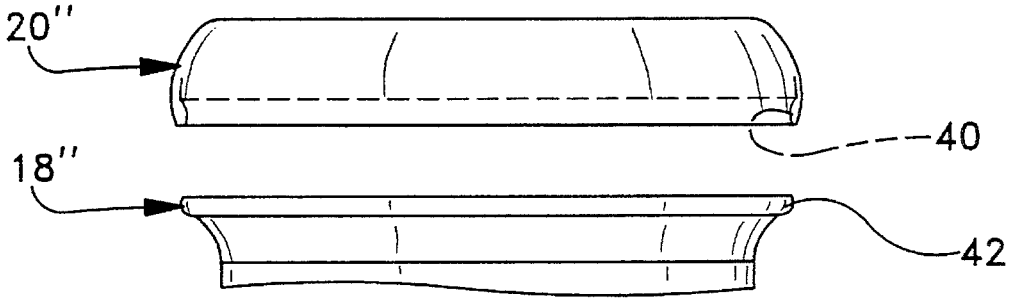
FIG. 4*b* is an exploded view of another alternative embodiment of the present invention wherein the lid and edges of the container include mating rubber grommets for sealing engagement.

A further embodiment of the present invention is depicted in FIG. 4*b* wherein lid portion 20" is provided with a grommet 40, preferably made of rubber, positioned to engage grommet 42 located on edge 18".

Figure 6A:
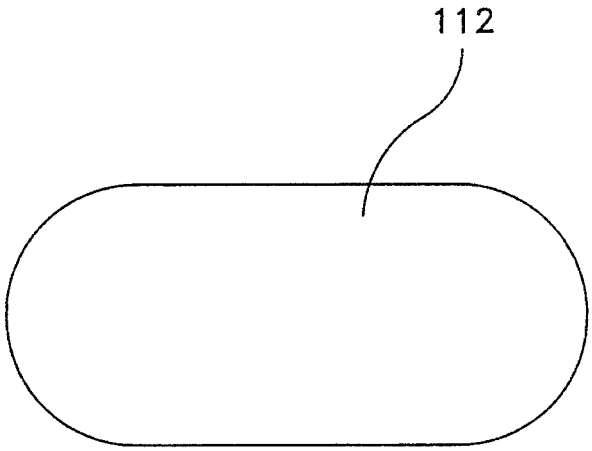
FIG. 6*a* depicts an alternative embodiment of the present invention wherein the silhouette of the base portion of the container forms a racetrack oval.
Figure 6B:
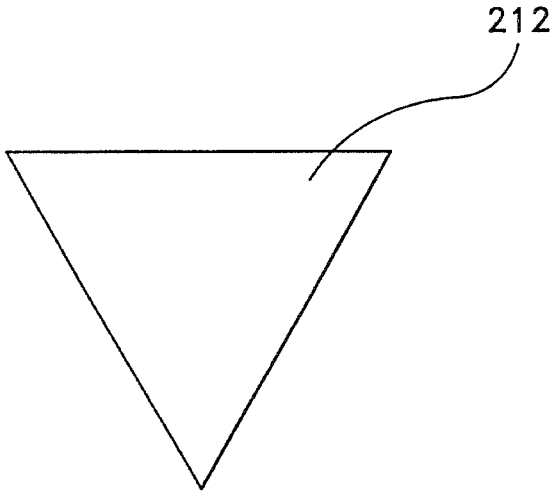
FIG. 6*b* depicts another alternative embodiment wherein the silhouette of the base portion of the container forms an isosceles triangle.
Figure 6C:
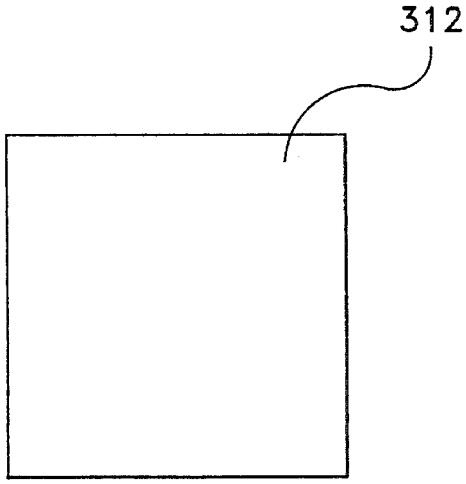
FIG. 6*c* depicts still another alternative embodiment wherein the silhouette of the base portion of the container forms a square.
Figure 7:
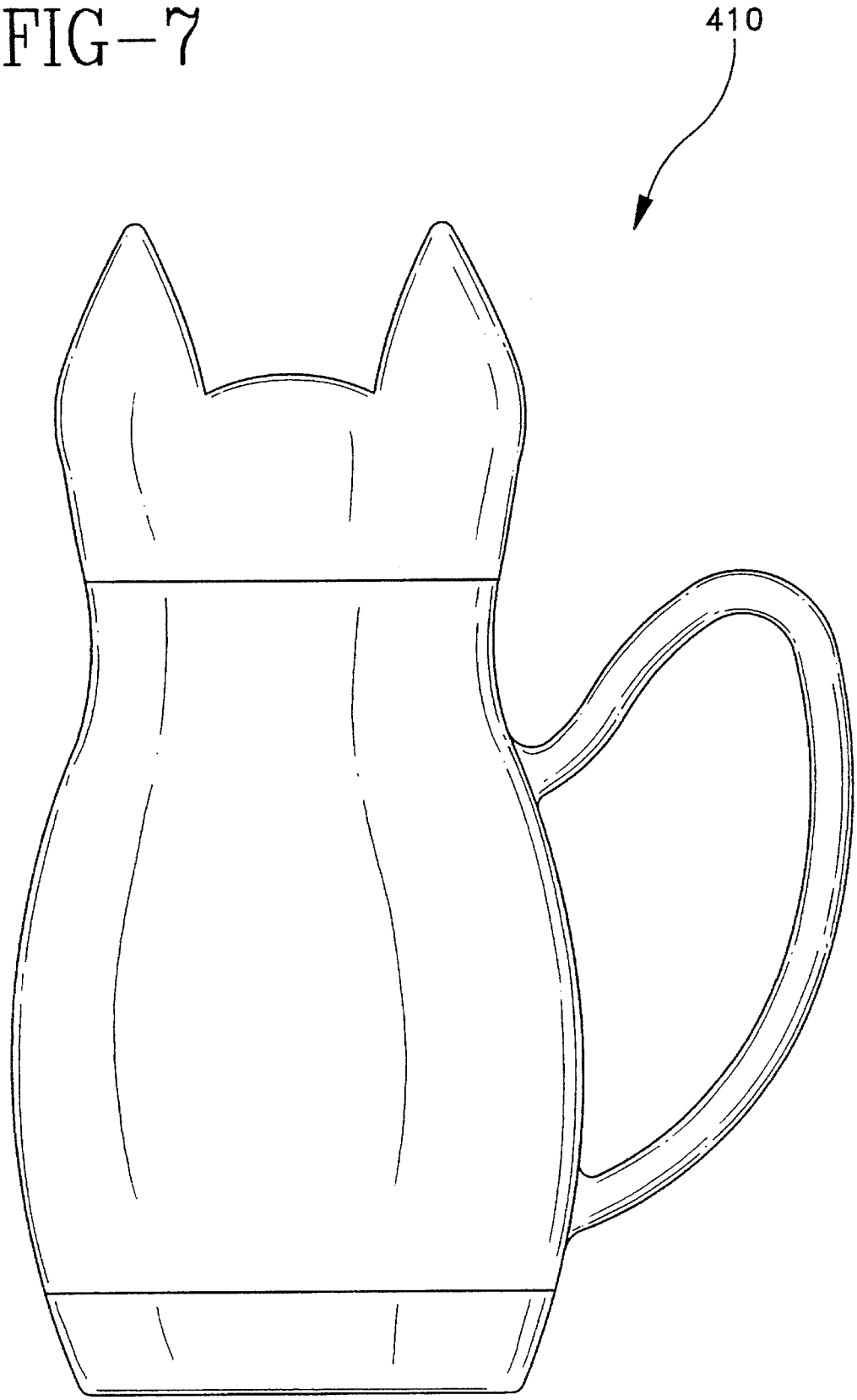
FIG. 7 shows a novelty safety container made in accordance with the present invention.

In an alternative embodiment, the base portion (i.e., base portion 112) of the safety container may be formed with a shape whose silhouette forms a racetrack oval as depicted in FIG. 6*a*. FIG. 6*b* depicts another alternative embodiment of the base portion of the present invention wherein the silhouette of the base portion (i.e., base portion 212) forms an isosceles triangle. FIG. 6*c* depicts still another alternative embodiment of the present invention wherein the silhouette of the base portion (i.e., base portion 312) forms a square. Finally, the container of the present invention can be fabricated as a novelty container (i.e., container 410), that is, it can be formed in the shape of an animal, such as a cat, as shown in FIG. 7.

Figure 8:
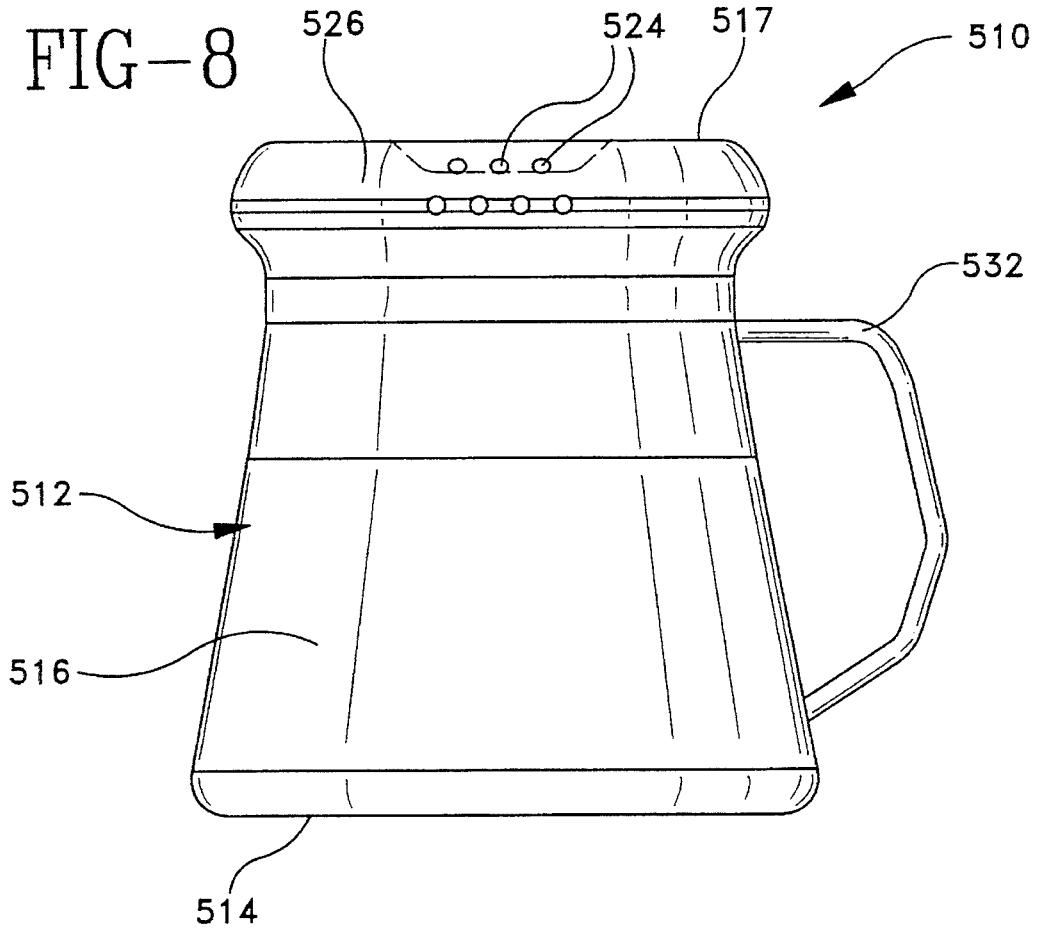
FIG. 8 is a side elevational view of a further alternative embodiment of the present invention.
Figure 9:
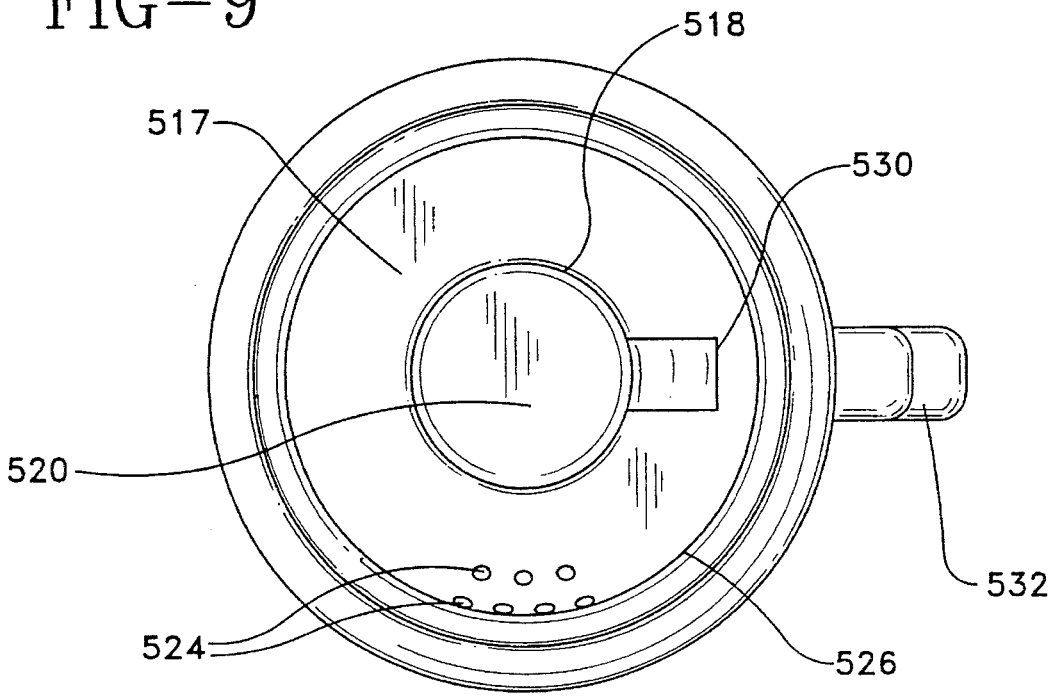
FIG. 9 is a top plan view of the container shown in FIG. 8.
Figure 10:
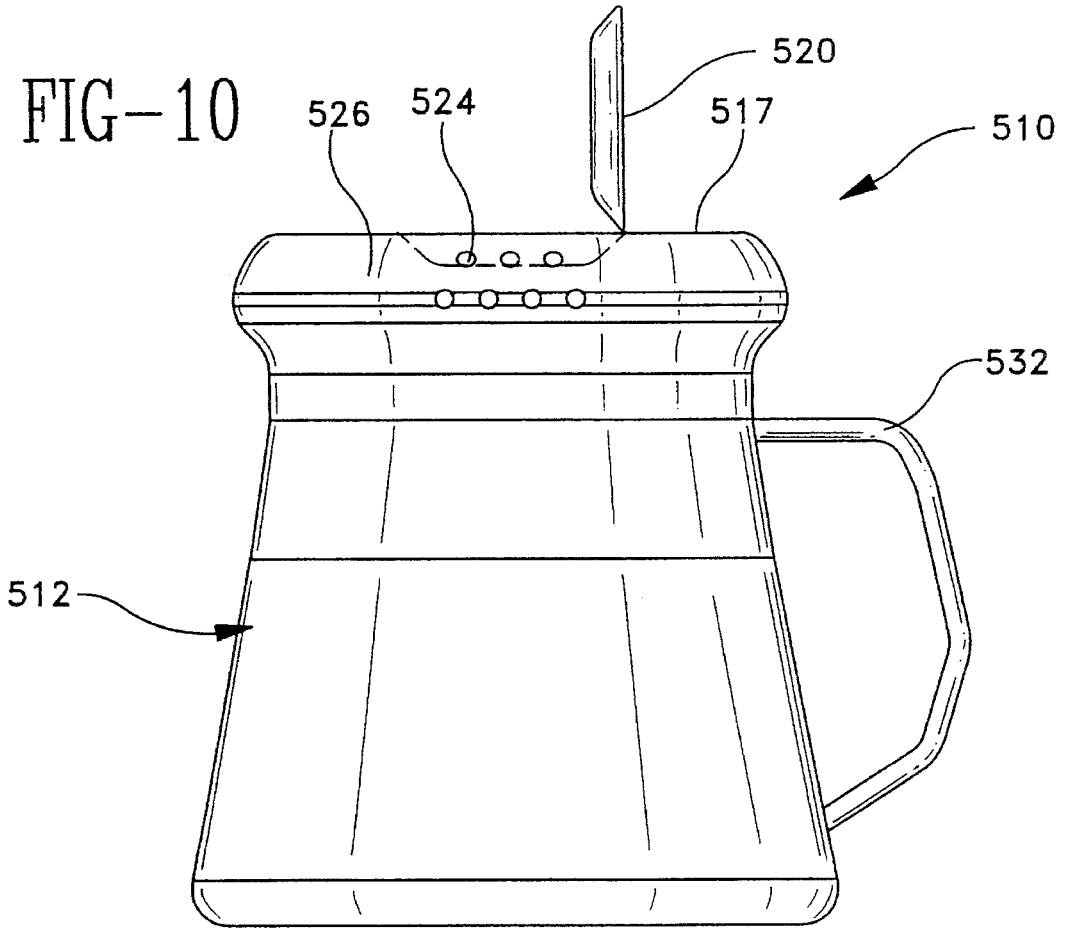
FIG. 10 is a view similar to FIG. 8 depicting the lid of the container in an open position.
Figure 11:
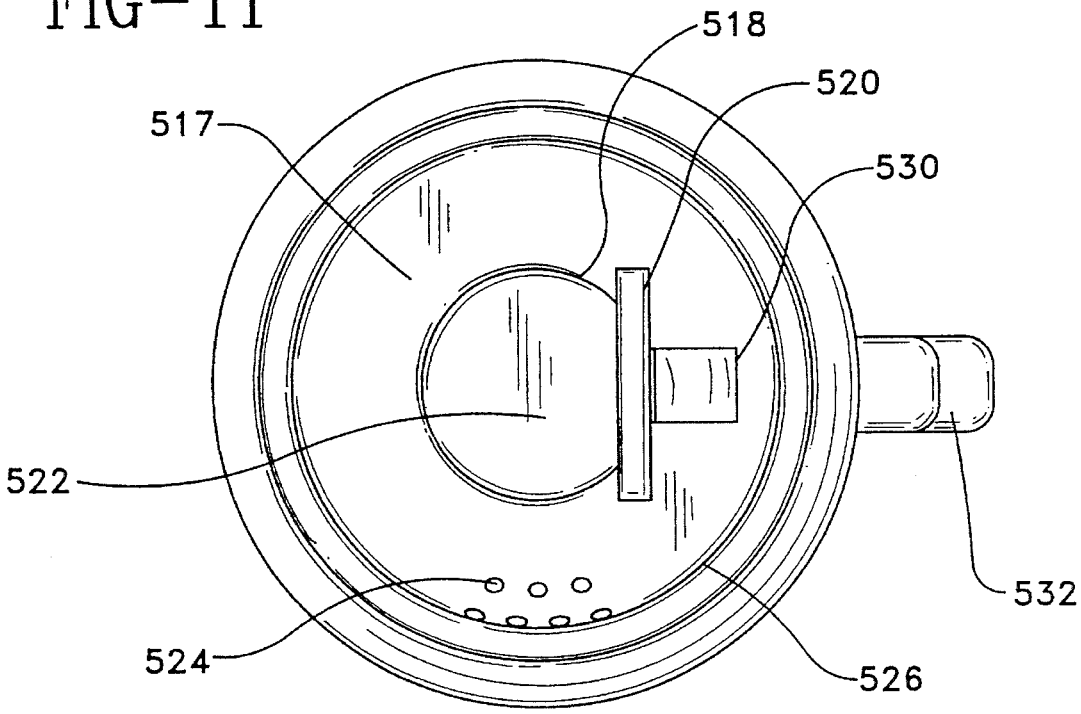
FIG. 11 is a top plan view of the container shown in FIG. 8 with the lid of such container in an open position.

In another preferred embodiment of the present invention, as illustrated in FIG. 8, a safety drinking cup 510 is provided. Cup 510 includes a base portion 512 having a bottom 514, a continuous side wall 516, a top 517 and an edge 518 (best shown in FIG. 11). Cup 510 also includes a lid portion 520 shaped and dimensioned to be removably secured to edge 518, thereby enclosing opening 522 (shown in FIG. 11) in base portion 512.

Cup 510 further includes at least one passage 524. As mentioned, the passage(s) connects the interior of base portion 512 (in which the liquid is stored) and the exterior of the cup. In the embodiment illustrated in FIGS. 8–11, this passage(s) is located in base portion 512. Preferably, the passage(s) is located in a lip portion 526 of base portion 512. This lip portion, which protrudes upwardly to facilitate across by the individual mouth, connects side wall 516 to top 517.

In similar fashion to cup 10, cup 510 preferably includes a plurality of passages 524. Further, the passages are preferably circular in construction and have a diameter between 1/32 and 1/16 inches. Moreover, in cup 510 the axis passing through passage 524 is preferably substantially perpendicular (or orthogonal) to a plane passing along the tangent of the surface of the base at that point, but may also be located at an angle $\Theta$ with respect to the plane passing along the tangent of the surface of the base at that point. Finally, cup 510 may include at least two passages located at a distance from one another so that during drinking the container is vented to the atmosphere.

As mentioned, lid 520 is configured to sealingly engage edge 518 when closed. Similar to lid 20, lid 520 may be configured to engage edge 118 in a number of manners, including a snap fit, a threaded engagement, and a friction fit, among others (see FIGS. 4, 4*a* and 4*b*, respectively). As shown, lid 520 is preferably recessed in top 517 so that the upper surface of the lid is flush with top 517 when the lid is closed. Alternatively, edge 518 and lid 520 may be laterally offset from the plane defined by top surface 517.

Edge 518 (like edge 18) is configured to induce uncontrolled fluid flow from the base portion if an individual attempts to drink directly from the opening in the base portion. Edge 518 is particularly well-suited to induce uncontrolled fluid flow because it is both centrally-located and recessed in top 517. Accordingly, even if the lid of the cup is entirely removed, an individual can not effectively place his or her mouth on the edge defining the opening of the cup and, hence, will be required to employ the safety drinking cup in its intended manner.

Cup 510 also includes a hinge 530 connected between top 517 and lid 520 for articulating lid 520 between an open and closed position. Finally, cup 510 includes a handle 532 for holding and manipulating the container during drinking of the beverage contained therein.

Thus, while there have been described what are presently believed to be the preferred embodiments of the invention, those skilled in the art will realize that various changes and modifications may be made to the invention without departing from the spirit of the invention, and it is intended to claim all such changes and modifications that fall within the scope of the invention.

What is claimed is:

1. A safety container for drinking liquids, comprising:

a base portion having a bottom, a continuous side wall extending upwardly from said bottom, and a top extending inwardly from said side wall and integral therewith, said top having an opening located interiorly of said side wall and substantially opposite said bottom, said opening defined by an edge formed in said top, said edge being configured to induce uncontrolled fluid flow to discourage an individual from consuming said liquid directly from said opening;

a lid portion shaped and dimensioned for being removably secured to said edge during liquid consumption; and at least one drinking passage formed in said base portion adjacent the perimeter of said top, spaced radially outwardly of said opening and arranged to be covered by the mouth of said individual during consumption of said liquid, said passage having a size which permits controlled flow of said liquid from said container.

2. The safety container of claim 1, wherein said opening is centrally-located in said top and of a diameter substantially smaller than the diameter of said top.

3. The safety container of claim 2, wherein said edge defining said opening is recessed in said top thereby effectively precluding an individual from consuming said liquid directly from said opening.

4. The safety container of claim 3, wherein said lid portion is recessed in said top.

5. The safety container of claim 1, wherein said base portion includes a plurality of passages, and wherein said passages are arranged sufficiently close together so as to be entirely covered by the mouth of said individual during consumption of said liquid.

6. The safety container of claim 5, wherein said base portion includes two sets of co-located multiple passages.

7. The safety container of claim 5, wherein each of said passages has a diameter between approximately 1/32 and 1/16 inches.

8. The safety container of claim 7, wherein said base portion includes seven passages each having a diameter of approximately 1/16 inch.

9. The safety container of claim 5, wherein at least one of said passages has an axis which is not normal to a plane passing along the tangent of the surface of the lid at that point.

10. The safety container of claim 1, wherein said base portion has a generally truncated cone silhouette with a substantially circular cross-section, and wherein said bottom is greater in cross-sectional dimension than the cross-section at said opening.

11. The safety container of claim 1, wherein said base portion has a shape whose silhouette defines a racetrack oval, and wherein said bottom is greater in cross-sectional dimension than the cross-section at said opening.

12. The safety container of claim 1, wherein said base portion has a shape whose silhouette defines an isosceles triangle, and wherein said bottom is greater in cross-sectional dimension than the cross-section at said opening.

13. The safety container of claim 1 wherein said base portion has a shape whose silhouette defines a square, and wherein said bottom is greater in cross-sectional dimension than the cross-section at said opening.

14. The safety container of claim 1, wherein said opening further comprises sealing means to form a liquid impervious seal between said base and lid positions to prevent leakage of liquid from said container.

15. The safety container of claim 14, wherein said sealing means comprises cooperative structure on said base and lid portions for friction fit of said lid portion to said base portion in sealing relationship therebetween.

16. The safety container of claim 14, wherein said lid portion further comprises a hinge attached to said base portion for articulation of said lid between an open position and a closed position with respect to said base portion.

17. The safety container of claim 1, wherein said base portion further comprises a handle.

18. The safety container of claim 1, wherein said base portion further comprises a lip portion arranged along its perimeter, said lip portion protruding upwardly to facilitate access by the consumers mouth and formed with at least one of said drinking passages.

19. The safety container of claim 1, wherein said edge includes a flange having a reverse angle slope around the perimeter thereof.

* * * * *